US005947298A

United States Patent [19]

Huang

[11] Patent Number: 5,947,298

[45] Date of Patent: Sep. 7, 1999

[54] ELECTRIC APPARATUS PACKING BAG

[75] Inventor: Peter K. H. Huang, Taipei, Taiwan

[73] Assignee: Shining Blick Enterprise Co., Ltd., Taipei, Taiwan

[21] Appl. No.: 09/203,741

[22] Filed: Dec. 2, 1998

[51] Int. Cl.[6] ..... B65D 85/42

[52] U.S. Cl. ..... 206/769; 206/420; 206/722

[58] Field of Search ..... 206/769–770, 206/771, 701, 722–726, 727, 419, 420

[56] References Cited

U.S. PATENT DOCUMENTS 4,858,763 8/1989 Scott ..... 206/419

4,903,892 2/1990 McNair et al. ..... 206/420

*Primary Examiner*—Jacob K. Ackun

*Attorney, Agent, or Firm*—Dougherty & Troxell

[57] ABSTRACT

An electric apparatus packing bag which holds an electric apparatus, allowing the electric apparatus to be electrically tested when maintained intact with the packing bag. The packing bag has a through hole at one side panel thereof through which the electric wire of the electric apparatus extends to the outside of the packing bag, and a pocket-like cover panel, which shields the through hole and, has a retaining portion, which holds the test terminal of the electric wire of the electric apparatus in place.

8 Claims, 5 Drawing Sheets

ELECTRIC APPARATUS PACKING BAG

BACKGROUND OF THE INVENTION

The present invention relates to packing bags, and more specifically to an electric apparatus packing bag which allows the packed electric apparatus to be maintained with the packing bag intact when making an electrical test at the selling point.

When an electric apparatus is made, it must be well packed before delivery. When buying a small electric item, the consumer may require the salesman to test the performance of the electric item. Before making an electric test, the packing material must be detached. After the test, the packing material must be packed with the electric item again. Furthermore, when a paper box is used to pack a small electric item for example a decorative string, partition and positioning means shall be used to hold the bulbs and lead wires of the decorative string in place. However, it is complicated to arrange the partition and positioning means, the bulbs and lead wires properly in the packing box. This packing method consumes much labor.

SUMMARY OF THE INVENTION

The present invention has been accomplished to provide an electric apparatus packing bag which eliminates the aforesaid problems. According to the present invention, the electric apparatus packing bag which holds an electric apparatus, allowing the electric apparatus to be electrically tested when maintained intact in the packing bag. The packing bag has a through hole at for example its front side panel through which the electric wire of the electric apparatus extends to the outside of the packing bag, and a pocket-like cover panel, which shields the through hole and, has a retaining portion, which holds the test terminal of the electric wire of the electric apparatus in place. When an electric test is required, the test terminal at the end of the electric wire of the electric apparatus is pulled out of the pocket-like cover panel, and connected to an electric outlet at the selling point.

DETAILED DESCRIPTION OF THE PREFERRED EMBODIMENT

Figure 1:
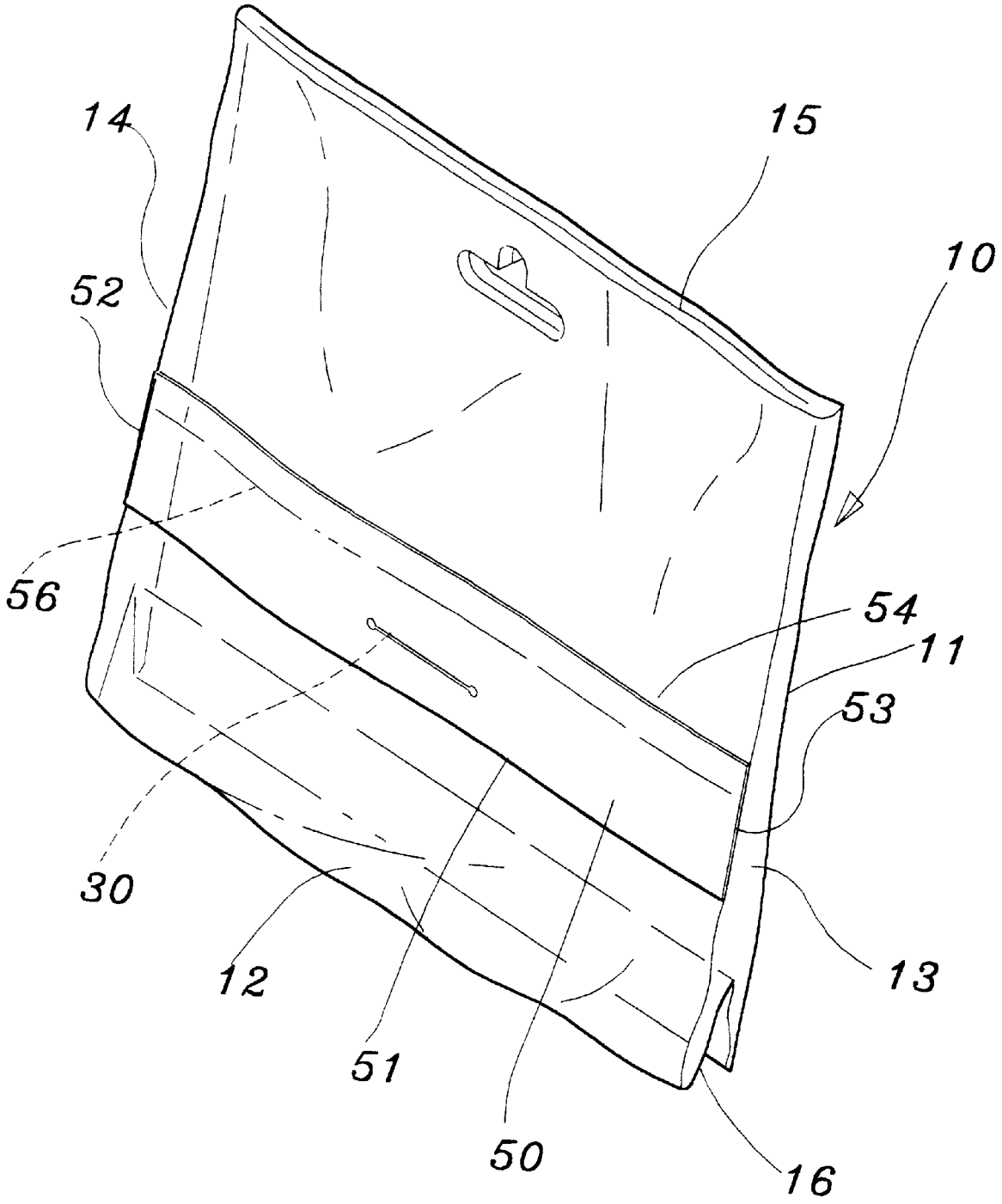
FIG. 1 is a perspective view of an electric apparatus packing bag according to the present invention.
Figure 2:
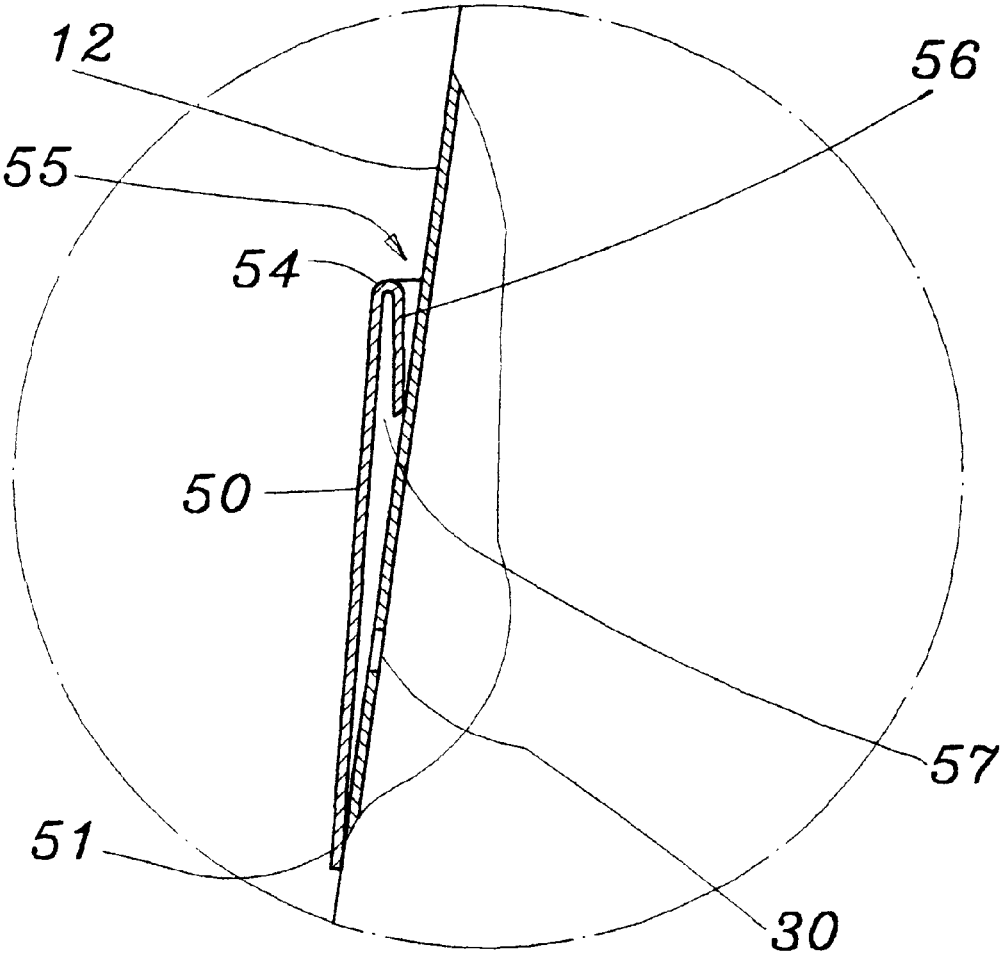
FIG. 2 is a sectional view in an enlarged scale of a part of FIG. 1, showing the arrangement of the cover panel and the through hole at the front side panel of the packing bag.

Referring to FIGS. 1 and 2, an electric apparatus packing bag 10 is shown having a front side panel 11, a back side panel 12, two lateral side panels 13,14 bilaterally connected between the front side panel 11 and the back side panel 12, a top side panel 15 and a bottom side panel 16 respectively connected between the front side panel 11 and the back side panel 12 at top and bottom sides. The top side panel 15 defines a mouth through which the inside of the packing bag 10 is accessible. The packing bag 10 can be made of paper, polyethylene, or any of a variety of suitable materials.

An elongated through hole 30 is provided at one panel for example the back side panel 12 of the packing bag 10. A cover panel 50 is provided at the outside surface of the back side panel 12 to shield the elongated through hole 30. The cover panel 50 has a certain height, and fits the transverse width of the packing big 10. According to the present preferred embodiment, the cover panel 50 has a bottom side 51 and two opposite lateral side 52,53 fixedly fastened to the back side panel 12 of the packing bag 10, and a top side 54 bent inwards and terminating in a folding flap 56. The folding flap 56 defines with the back side panel 12 a pocket mouth 55. The folding flap 56 also defines with the back wall of the cover panel 50 a downwardly extended retaining portion 57.

Figure 3:
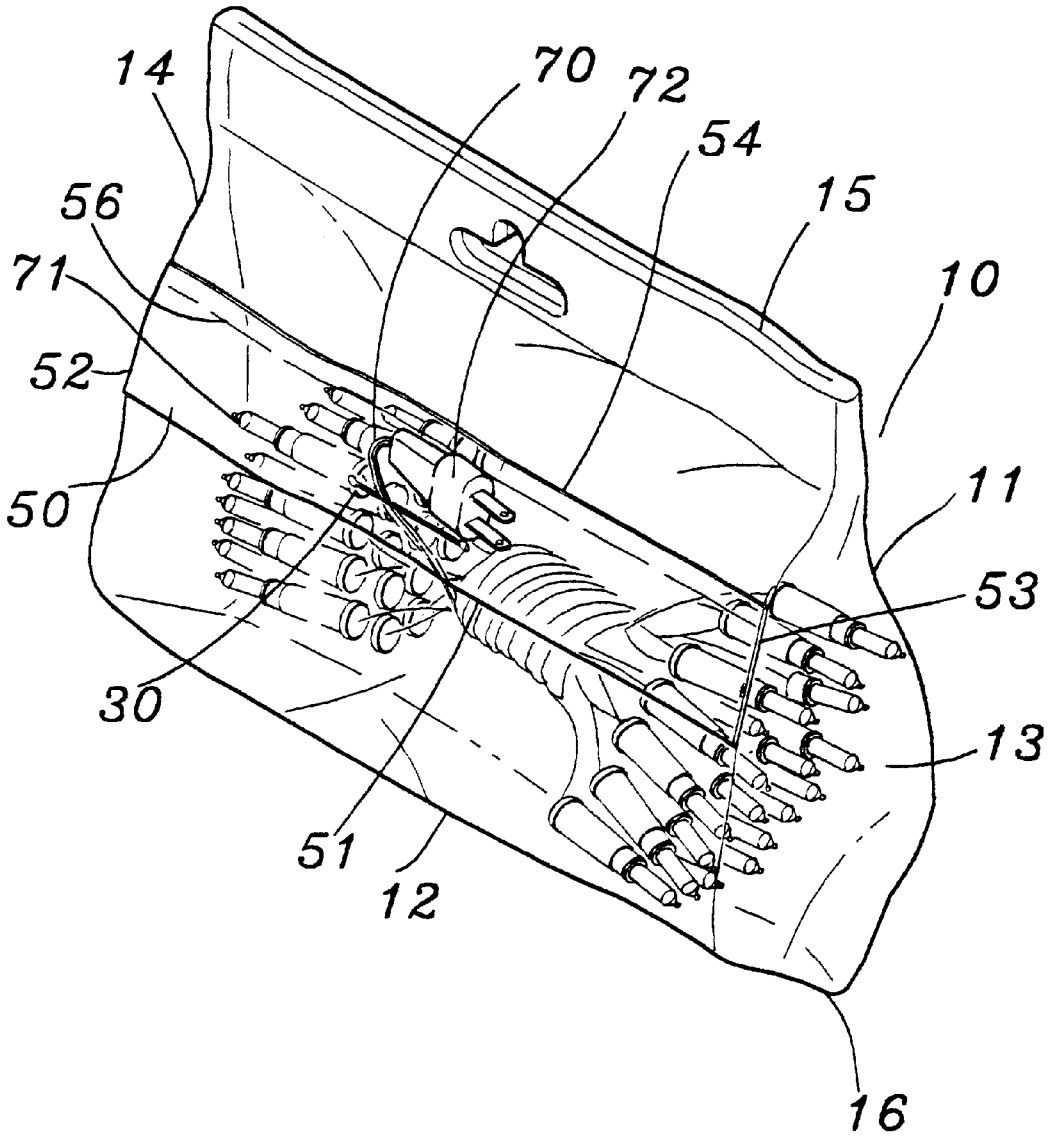
FIG. 3 is another perspective view of the present invention, showing a decorative string packed in the packing bag.
Figure 4:
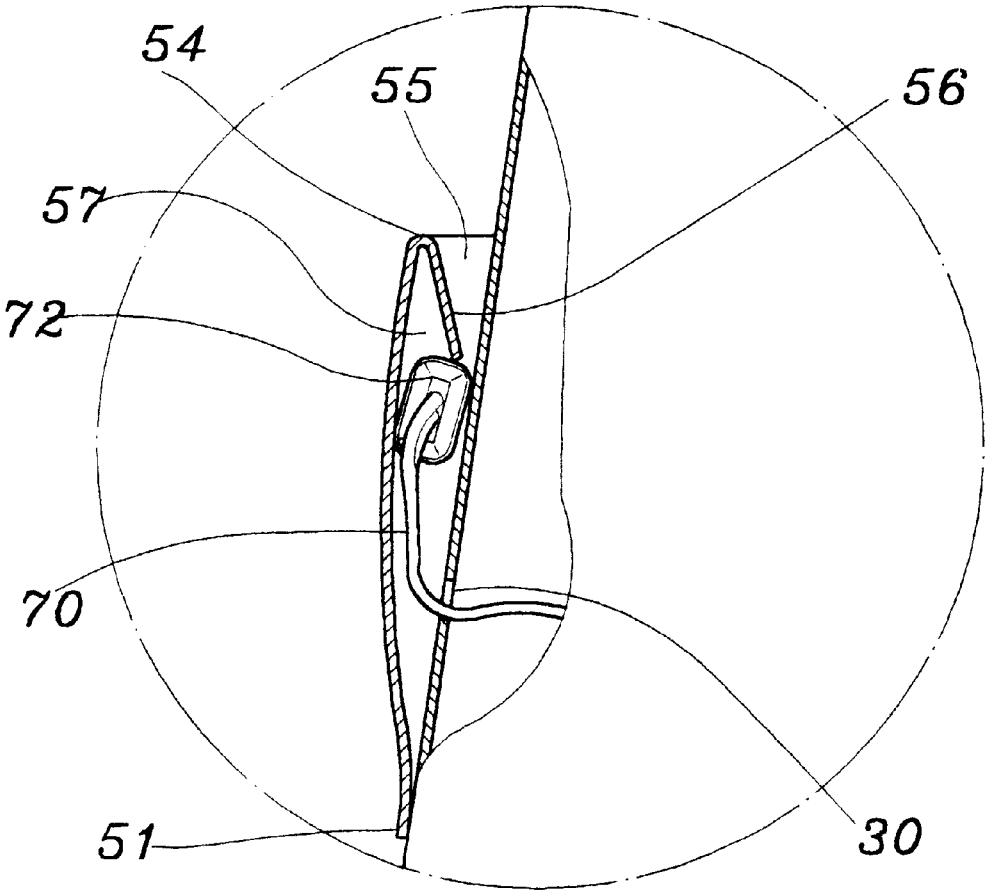
FIG. 4 is a sectional view in an enlarged scale of a part of FIG. 3, showing the electric plug of the electric apparatus retained to the retaining portion of the cover panel.

Referring to FIGS. 3 and 4, when an electric apparatus for example a decorative string is put in the packing bag 10), the electric wires 70 and bulbs 71 are received in inside the packing bag 10, and the electric plug 72 at one end of the electric wires 70 is inserted through the elongated through hole 30 to the holding space defined between the cover panel 50 and the back side panel 12, and retained to the retaining portion 57. Because the electric plug 72 is retained to the retaining portion 57 in the holding space defined between the cover panel 50 and the back side panel 12., it is prohibited from escaping out of the packing bag 10 during delivery.

Figure 5:
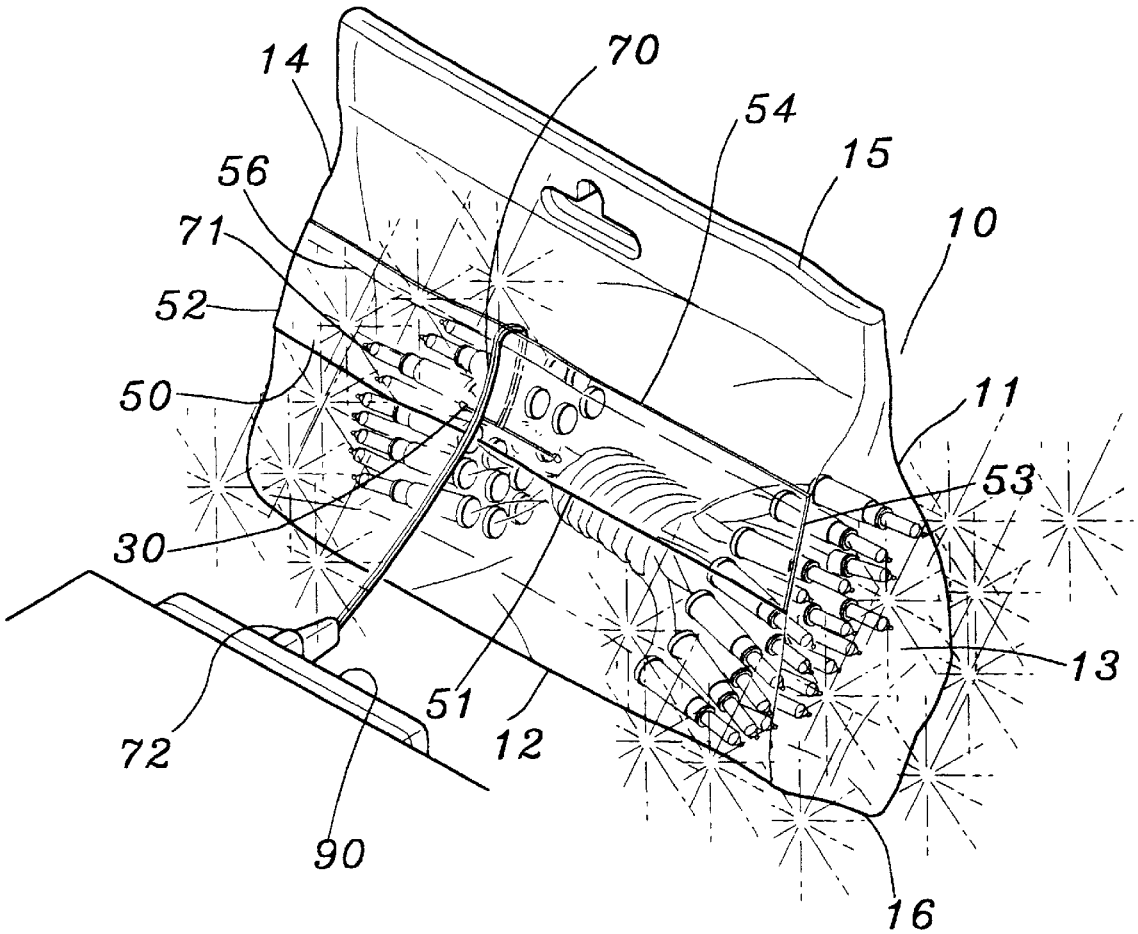
FIG. 5 is similar to FIG. 3 but showing the electric plug pulled out of the cover panel and connected to an external electric outlet.

Referring to FIG. 5, the electric plug 72 can be pulled away from the retaining portion 57 and taken out of the holding space defined between the cover panel 50 and the back side panel 12 through the pocket mouth 55, and connected to an electric outlet 90 to test the circuit of the electric apparatus (decorative string). After test, the electric plug 72 is pulled back and retained to the retaining portion 57 in the holding space defined between the cover panel 50 and the back side panel 12.

Further, the electric wires 70 and bulbs 71 are packed together simply by for example binding wires, and then put in the packing bag 10. Because the electric apparatus (decorative string) is received in the packing bag 10, it is not necessary to use labor or machine to arrange the electric wires 70 and bulbs 71 of the decorative string in position.

While only one embodiment of the present invention has been shown and described, it will be understood that various modifications and changes could be made thereunto without departing from the spirit and scope of the invention disclosed. For example, the elongated through hole and the cover panel can be made at either side of the packing bag as desired.

What the invention claimed is:

1. An electric apparatus packing bag holding an electric apparatus having an electric wire and a test terminal at the end of the electric wire, the electric apparatus packing bag comprising a through hole at one assigned side panel thereof for passing of the electric wire of the electric apparatus held in the packing bag, and a cover panel fastened to one side panel of the packing bag to shield said through hole, said cover panel having a bottom side and two opposite lateral sides fixedly fastened to the assigned side panel of the packing bag and a top side spaced from the assigned side panel of the packing bag and defining with the assigned side panel of the packing bag a pocket mouth, the top side of said cover panel being bent inwards and terminating in a folding flap, said folding flap defining with a back wall of said cover panel a downwardly extended retaining portion for securing the test terminal of the electric wire of the electric apparatus held in the packing bag.

2. The electric apparatus packing bag of claim 1 wherein said cover panel fits the transverse width of the packing bag.

3. The electric apparatus packing bag of claim 1 wherein said test terminal is an electric plug.

4. The electric apparatus packing bag of claim 1 wherein said through hole fits the shape of said test terminal.

5. The electric apparatus packing bag of claim 1 wherein said through hole has an elongated shape.

6. The electric apparatus packing bag of claim 1 wherein said through hole and said cover panel are provided at one of front and back side panels of the packing bag.

7. The electric apparatus packing bag of claim 1 wherein said through hole and said cover panel are provided at one of two lateral side panels of the packing bag.

8. The electric apparatus packing bag of claim 1 wherein said through hole and said cover panel are provided at one of top and bottom side panels of the packing bag.

* * * * *